US011815261B2

(12) United States Patent
Alvarez et al.

(10) Patent No.: US 11,815,261 B2
(45) Date of Patent: Nov. 14, 2023

(54) STEAM GENERATOR, AND SYSTEM FOR STEAM CLEANING WORKPIECES

(71) Applicant: ELWEMA Automotive GmbH, Ellwangen (DE)

(72) Inventors: Antonio Alvarez, Stolberg (DE); Dietmar Sonntag, Simmerath (DE)

(73) Assignee: ELWEMA AUTOMOTIVE GMBH, Ellwangen (DE)

( * ) Notice: Subject to any disclaimer, the term of this patent is extended or adjusted under 35 U.S.C. 154(b) by 864 days.

(21) Appl. No.: 16/756,033

(22) PCT Filed: Nov. 2, 2018

(86) PCT No.: PCT/EP2018/080070

§ 371 (c)(1),
(2) Date: Apr. 14, 2020

(87) PCT Pub. No.: WO2019/086641

PCT Pub. Date: May 9, 2019

(65) Prior Publication Data

US 2020/0309362 A1 Oct. 1, 2020

(30) Foreign Application Priority Data

Nov. 2, 2017 (DE) ..... 10 2017 125 666.0

(51) Int. Cl.
*F22B 1/28* (2006.01)
*B08B 3/02* (2006.01)
(Continued)

(52) U.S. Cl.
CPC ..... *F22B 1/287* (2013.01); *B08B 3/02* (2013.01); *B08B 3/14* (2013.01); *F22B 27/16* (2013.01);
(Continued)

(58) Field of Classification Search
CPC . B08B 2230/01; B08B 2203/00; F22G 1/165; F22B 1/287
See application file for complete search history.

(56) References Cited

U.S. PATENT DOCUMENTS 6,299,076 B1 10/2001 Sloan et al.
3,132,545 A1 3/2012 Cho
(Continued)

FOREIGN PATENT DOCUMENTS

DE 000003779634 T2 2/1993
DE 102014101123 A1 7/2015
(Continued)

OTHER PUBLICATIONS

Int'l Preliminary Report on Patentability dated May 5, 2020 in Int'l Application No. PCT/EP2018/080070.
(Continued)

*Primary Examiner* — Steven S Anderson, II
(74) *Attorney, Agent, or Firm* — Panitch Schwarze Belisario & Nadel LLP

(57) ABSTRACT

A device for cleaning workpieces with a steam jet is proposed, with a special steam generator in which the steam is generated in a hollow cylindrical core, whose outer side is heated and onto whose inner side the water to be vaporized is sprayed by means of a nozzle. The steam generator has a supplementary heating device with a heatable body having a cavity through which steam generated upstream can flow for post-heating it, in order to generate dry steam for dry steam cleaning. An automated cleaning system with this steam generator is also proposed. The device can be adapted flexibly to the requirements of automated synchronized production and requires, in particular, less energy and floor space. The invention can be used, among other things, in industrial cleaning in manufacturing systems engineering, in particular in the production of automotive parts.

19 Claims, 4 Drawing Sheets

(51) Int. Cl.

| | |
|---|---|
| ***B08B 3/14*** | (2006.01) |
| ***F22B 27/16*** | (2006.01) |
| ***F22B 37/60*** | (2006.01) |
| ***F22G 1/16*** | (2006.01) |

(52) U.S. Cl.
CPC ..... *F22B 37/60* (2013.01); *F22G 1/165* (2013.01); *B08B 2203/00* (2013.01); *B08B 2230/01* (2013.01)

(56) References Cited

U.S. PATENT DOCUMENTS

| | | | | |
|---|---|---|---|---|
| 2005/0269316 | A1* | 12/2005 | Monteleone ..... | H05B 6/802 219/688 |
| 2009/0025657 | A1 | 1/2009 | Cho | |
| 2019/0210073 | A1 | 7/2019 | Alvarez et al. | |

FOREIGN PATENT DOCUMENTS

| | | | | | |
|---|---|---|---|---|---|
| DE | 102016107840 | A1 | | 11/2017 | |
| EP | 0302125 | A1 | | 2/1989 | |
| EP | 0395843 | A2 | | 11/1990 | |
| EP | 1380795 | A1 | | 1/2004 | |
| JP | 108110001 | A | | 4/1996 | |
| JP | H11108301 | A | | 4/1999 | |
| WO | WO-2004018936 | A1 | * | 3/2004 | ..... A61H 33/12 |
| WO | WO-2004068033 | A1 | * | 8/2004 | ..... B24B 49/105 |
| WO | 2011124868 | A1 | | 10/2011 | |
| WO | WO-2017021141 | A1 | * | 2/2017 | ..... F22B 1/282 |

OTHER PUBLICATIONS

Search Report dated Aug. 9, 2018 in DE Application No. 10 2017 125 666.0.

Int'l Search Report and Written Opinion dated Feb. 1, 2019 in PCT/EP2018/080070, translation of Search Report only.

* cited by examiner

STEAM GENERATOR, AND SYSTEM FOR STEAM CLEANING WORKPIECES

CROSS-REFERENCE TO RELATED APPLICATIONS

This application is a Section 371 of International Application No. PCT/EP2018/080070, filed Nov. 2, 2018, which was published in the German language on May 9, 2019, under International Publication No. WO 2019/086641 A1, which claims priority under 35 U.S.C. § 119(b) to German Application No. 10 2017 125 666.0, filed Nov. 2, 2017, the disclosures of each of which are incorporated herein by reference in their entireties.

BACKGROUND OF THE INVENTION

The invention relates, in general, to the industrial cleaning of workpieces by means of a steam jet, as well as to a steam generator that is especially suitable for this purpose. It concerns, in particular, the steam cleaning of components manufactured in large-scale production or assemblies, e.g., for or in the automotive industry. These components can be, e.g., machined components, such as components of internal combustion engines, transmissions, or other machined parts, especially for the drive train of a motor vehicle. The invention is not limited, however, to the cleaning of parts for conventional internal combustion engines or electric drive trains, but can also be used very generally in automated production.

The proposed steam cleaning system is suitable both for intermediate cleaning (before a subsequent processing sequence), e.g., for cleaning off MQL processing residue, or for reducing the load on a subsequent final cleaner. Depending on the type of component and the cleaning requirements, it could also be used for the actual final cleaning.

Modern mass production uses automatic assembly lines, in which a cleaning system might need to be integrated. Especially in the automotive industry, cleaning processes play a crucial role, because the requirements on the cleanliness of components (residual soiling, particle size, etc.) are strict and crucial especially for engines and transmissions. Typically, e.g., metallic parts are machined using metal-cutting processes, wherein lubricants are used, and chips or burrs are produced. Before such workpieces can be further processed or assembled into modules, contaminants, such as residues of cooling lubricants, must be removed.

In recent years, so-called minimum quantity lubrication (MQL) has become common, among other things, for metal-cutting machining. From DE 10 2014 101 123 A1, a method and a system for cleaning a metallic workpiece after metal-cutting machining processes using MQL is known. Here, a cleaner concentrate is deposited and after a predetermined residence time, the surface is treated with a steam jet. The structure of the steam generator is not disclosed.

Another method, especially for cleaning workpieces made of metal after metal-cutting processing, is previously known from WO 2011/124 868 A1. Here, a steam jet is shielded by a compressed air jet. The shielding compressed air jacket is intended to protect the steam jet from frictional losses and thus to increase its effectiveness in degreasing. As the steam generator, here a conventional boiler-type steam generator or a continuous-flow steam generator has been proposed. Conventional steam boilers are slow and energy inefficient and require significant installation space.

U.S. Pat. No. 6,299,076 B1 describes a steam cleaning system for workpieces, especially for the semiconductor industry. For improving the heat transfer and for reducing the Leidenfrost effect, a porous coating is provided on the inner surface of the steam generator.

A high-speed steam generator appears to be more useful for steam jet cleaning. DE 37 79 634 T2 and EP 0 302 125 A1 describe a high-speed steam generator for various household applications, but it is not designed for industrial purposes.

Typical high-speed steam generators are once-through forced-flow boilers and continuous-flow water tube boilers. In this construction, a continuous flow of the water/steam jet is forced through a spiral-shaped tube that is heated from the outside with a gas or oil burner. Continuous-flow steam generators are previously known based on the Stone-Vapor, Clayton, or Sulzer and Benson principles. There are energy-efficient continuous-flow water tube boilers, e.g., with multiple interleaved coiled tubes and exhaust gas heat recuperation, which can provide steam within approx. 3 minutes after startup. These are expensive and complicated and maintenance-intensive. They are designed for smaller quantities of steam, like those required for steam cleaning and are not optimized for synchronized operation in mass production cycles.

In the published DE 10 2016 107 840 A1, a device for the industrial steal jet cleaning of a workpiece is described. This comprises a cleaning container, a holding and feeding device that can hold the workpiece, rotate it, and feed it into the cleaning container and back out again, at least one steam nozzle that can be positioned relative to the workpiece in the cleaning container, and a steam generator. Here, an electrode steam generator that is intended to be operated with mineral water of sufficient conductivity is described as preferred. Electrode steam generators typically contain a defined water supply and are relatively slow in operation, i.e., they cannot be started up or shut down quickly. This is disadvantageous, however, for the continuous cleaning of workpieces in cycles of a few minutes or shorter, because no steam is needed during the feeding or switching of the workpiece. Nevertheless, the steam generator is to be kept at a certain temperature, which consumes energy unnecessarily. This could be compensated for to a certain extent if the steam generator has a buffer volume and collects steam during the feeding cycles. This, however, requires a large volume and complicated design.

For continuous cleaning methods, depending on the type of soiling to be removed during the cleaning, either saturated steam or dry steam can be used selectively. Both continuous-flow water tube boilers and also electrode steam generators must be specially designed for cleaning with dry steam. Typically, they must contain a defined water supply and are equipped with an additional superheater. This is also complicated and expensive and requires additional energy expense and installation space.

Dry steam is understood here to be steam with a temperature above the boiling temperature, which, however, relative to saturated steam, was, in particular, only slightly superheated. Superheated steam would also be considered covered by the term "dry steam" in this document, but in terms of cleaning for industrial purposes it is usually not required and would be less useful in terms of energy.

An energy-efficient and compact steam generator for general industrial applications was already proposed in EP 1 380 795 A1. This steam generator would be suitable for synchronized operation, but is designed for generating saturated steam, i.e., not for dry steam.

With respect to the proposed steam generator, the teaching from U.S. Pat. No. 8,132,545 B2 is considered the closest prior art.

U.S. Pat. No. 8,132,545 B2 describes a steam generator with a jacket with a heatable, cylindrical inner surface and a heating device for heating the inner surface. A spray nozzle that is connected to a pressure pump sprays water onto the heated inner surface. This steam generator is designed for internal pressures over 10 bar and temperatures over 150° C. In one embodiment (FIG. 4), an additional heating rod is provided as a supplementary heating unit in the interior of the jacket, in order to feed additional heat to the steam in the interior. Such a steam generator is more energy-efficient thanks to the injection of water droplets and also permits, in principle, the generation of dry steam using the supplementary heating unit.

BRIEF SUMMARY OF THE INVENTION

One basic goal is to disclose a device and a method for the industrial cleaning of workpieces, which can be better adapted to the timed cycles of production and to the cleaning task and/or offer an especially compact construction. In addition, the energy consumption for generating steam should also be reduced compared to known steam generators.

A first task of the invention is to disclose a suitable steam generator that is improved relative to the prior art. This should be suitable, in particular, for use in the device according to an embodiment of the invention for cleaning workpieces, should require minimal installation space, and should have the lowest possible energy consumption.

A steam generator and device according to the claims achieve this task independently from each other. Furthermore a use for automated industrial cleaning as claimed is proposed. The dependent claims relate to preferred embodiments.

For the purpose of cleaning workpieces by means of a steam jet, an industrial cleaning system according to the class comprises a cleaning chamber, which can be tightly sealed preferably against the discharge of steam, at least one steam nozzle in the cleaning chamber for applying steam onto a workpiece, wherein the steam nozzle can be arranged fixed in place or can be positioned, and at least one steam generator that supplies the steam nozzle with steam. Furthermore, for automating the cleaning system, a suitable handling device is provided, by means of which the workpiece and the at least one steam nozzle can be positioned relative to each other, in order to subject the desired areas of the workpiece to the cleaning process.

According to an embodiment of the invention, a special design of the steam generator is proposed. This distinguishes itself initially in that:

- the steam generator has a heatable, jacket-like core element, which has a heatable, preferably cylindrical inner surface made from a thermally conductive material, and is equipped with at least one heating device mounted on the core element, in particular, on its outside, for heating the inner surface, and
- the steam generator comprises at least one spray nozzle that is directed toward the heatable inner surface, in order to spray water in a dosed manner onto this inner surface. The spray nozzle(s) is/are connected to a water inlet and a steam outlet is allocated to the core for the discharge of the generated steam.

This construction permits only the quantity of water that is needed accordingly for the steam cleaning process to be injected and vaporized in a targeted and controllable manner—without negatively affecting the quality of the cleaning. This enables considerable energy savings and also water savings, because unnecessary steam generation is prevented. Because, among other things, water buffer volumes are completely omitted, a considerable reduction of the required installation space is produced. Due to the correspondingly dosed addition of water, a faster and less sluggish steam generation is enabled, which makes possible, in turn, a better integration into modern, highly flexible production systems.

The steam generator of the device according to an embodiment of the invention thus contains no reservoir of liquid water, but instead merely a heated inner surface, on which, in small quantities, sprayed water is vaporized in a short time period. This makes it possible to quickly turn on and shut down the system in sync with the assembly line. The steam generator is also extremely compact.

A preferred cylindrical shape of the heatable core and optionally also of the container enables a space-saving integration into the cleaning device in the form of one or more "steam cartridges."

The steam generator according to an embodiment of the invention is further distinguished in that upstream of the steam outlet, preferably in the interior of the steam generator container, there is an additional supplementary heating device that can carry a flow of steam for post-heating this flow of steam. Through the selective switching on or off of the supplementary heating device, the steam generator can generate both dry steam and also saturated steam. The supplementary heating device can carry a flow of steam before this leaves the steam generator. Thus, the generated saturated steam can be superheated to dry steam.

Through the arrangement of the supplementary heating device at least partially, preferably completely in the container, especially in the cavity of the core, the flow path of the steam is shortened compared with an external superheater and special thermal insulation of the additional heating device is unnecessary. This also promotes a compact construction and saves energy for post-heating of the steam.

The steam generator according to an embodiment of the invention is suitable for generating dry steam. It can provide, if needed, both saturated steam and also dry steam with little added expense.

Advantageously, the additional heating device is arranged in the axis of the cylindrical container at the steam outlet for post-heating.

The supplementary heating device can have, in particular, a heatable body with a secondary cavity through which steam generated upstream in the primary cavity of the core can flow for post-heating it to dry steam. The secondary cavity is connected at an inlet side via a passage opening to the primary cavity of the core and at an outlet side to the steam outlet. The passage opening can be arranged radially or axially with respect to a primary axis of the core.

In one preferred embodiment, the passage opening comprises or forms a cross-sectional constriction which causes a pressure difference, in particular with a lower pressure in the secondary cavity of the supplementary heating device than in the primary cavity inside the core. In this way, a discharge of water mist in liquid phase is prevented and also, thanks to the lower pressure in the reheater, the energy requirements for post-heating to dry steam is reduced. The cross-sectional constriction can be realized in any construction suitable for a pressure drop, e.g., as a throttle, slit, hole, nozzle, etc.

In one preferred embodiment, the primary heating device comprises a controllable electrical heating element and the supplementary heating device comprises at least one separately controllable electrical heating element. This permits additional energy savings and, if necessary, the generation of both saturated steam and also dry steam, e.g., while switching off the post-heating.

In another embodiment, a dosing valve can be provided on each steam generator for selective dosing, in order to operate the steam generator in a dosed or also, e.g., pulsed manner. In this way, each steam generator can be operated individually, which makes it possible to adjust the steam generation output power in stages or also permits maintenance during continuous operation through redundancy. Multiple identical steam generators can be operated as a battery in parallel in a dosed manner.

In one compact embodiment, the steam generator container is configured in substantially cylindrical shape with an inner core with a cavity, e.g. a hollow cylinder as a heatable jacket, which is closed in a pressure-tight manner at its end faces. Here, thermal insulation is provided preferably between the inner core and an outer jacket of the steam generator container. Advantageously, the water inlet and steam outlet are arranged on opposite end faces of the cylindrical steam generator, especially preferred in the axis of the cylinder. In this way, among other things, a compact integration of the steam generator into the device according to an embodiment of the invention is promoted.

The spray nozzle can have spray characteristics oriented coaxial to the cylinder axis of the core or the jacket. The steam generator container is preferably aligned vertically with its cylinder axis in the assembled position. The spray characteristics can be, e.g., a hollow cone—in order to spread the injected water droplets over a large surface area as much as possible on the inner surface. Through a vertical alignment, draining of not-yet vaporized liquid onto the inner surface is achieved, which supported complete vaporization.

In particular, a misting nozzle (also called atomizer nozzles or diffusor nozzles) could also be used as the spray nozzle. Misting nozzles atomize the water into very fine droplets with large specific surface. In such nozzles, the spray characteristics are of subordinate significance, because, e.g., the mist can be distributed through convection in the primary cavity of the core.

Like the spray nozzle, the additional heating device is also preferably arranged symmetrically with respect to or in the axis of the cylindrical steam generator container. Regardless of this, the heating device is preferably provided on the steam outlet for post-heating, and opens, in particular, directly into the steam outlet. For an especially compact construction, the supplementary heating device is accommodated at least to a major proportion of its overall length axially inside the core. The heatable body of the supplementary heating device (reheater) is preferably accommodated completely inside the core. This permits further energy savings, because the body is arranged in the already heated core and heat losses are minimized for post-heating.

The system preferably comprises a pump which is arranged upstream of the water inlet and which applies a feed water pressure suitable for injection to the spray nozzle. The feed water pressure can preferably be in the range from 1 to 10 bar (atm), in particular in the range from 2 to 9 bar (atm).

The feed pressure of the spray nozzle should exceed the operating pressure desired in the primary cavity of the core during the steam generation, this can be, e.g., between 3-6 bar (atm), e.g., at approx. 4 bar.

Preferably, the device or system according to an embodiment of the invention comprises a control unit that controls at least the relative motion between the workpiece and steam nozzle, and the operation of the steam generator, in particular the steam nozzle or the dosing valve for the steam nozzle, adapted to each other. This means, for example, that the steam generation can be stopped while a workpiece is being fed in and removed, because during that time no cleaning is taking place and no steam is needed. It is also possible to interrupt or modify the steam supply if this is advantageous during the relative motion of the workpiece in the cleaning chamber, for example, if the steam jet touches the workpiece multiple times in one direction or if areas have different amounts of soiling and are to be cleaned, e.g., selectively with saturated steam or dry steam and/or with different quantities of steam.

The control unit can preferably also control the supply of electrical energy to heating elements of the primary heating device, e.g., to heating conductors on the outside of the container of the steam generator, so that it is adapted to the water quantity fed into the steam generator and/or the output quantity of steam. A corresponding situation also applies to the separately controllable supplementary heating device.

Likewise, the device is advantageously equipped so that the steam generator can discharge steam in a pulsed form. For example, this can be realized by switching on and off the water inlet and/or a valve on the steam outlet. Here, a pulsed form means a change of the steam flow from approx. 0 to a maximum value within 0.1-10 seconds. These functions can also be controlled by the control unit in coordination with the other production steps.

Preferably, for the pulsed or synchronized steam discharge, a controlled dosing valve is provided in the supply line directly upstream at the steam nozzle(s).

A spray nozzle with hollow cone characteristics and/or with a nozzle geometry that guarantees a volume flow <0.2 l/min, preferably <0.15 l/min at a nozzle inlet pressure <10 bar, has proven especially preferred, in order to further optimize water and energy consumption. If larger quantities of steam are required, a corresponding number of structurally identical steam generators can be used.

In an additional preferred embodiment, the system according to an embodiment of the invention therefore comprises equivalent steam generators of the type described above. The steam generators can be used in a modular manner as "steam cartridges" and are integrated into the device according to an embodiment of the invention, e.g., in groups in the form of one or more batteries with, for example, 2, 3, 4, or 6 instances of structurally identical steam cartridges.

This embodiment offers a series of additional advantages. First, each individual steam generator can have a smaller construction. In this way, they are also sufficiently pressure-tight even with smaller material thicknesses and therefore can be produced more economically in total. They can also be more easily integrated in a compact cleaning device, because their geometric arrangement can be adapted to the given specifications. Through the individual control of the individual steam generators or also individual batteries, the device can also be flexibly adjusted to changing steam requirements during the cleaning. Finally, cleaning devices of different sizes can be equipped with a uniform embodiment of the steam generator that can be produced more economically, if these are provided in different quantities according to the size of the device.

Water inlets and/or steam outlets can be constructed and controlled for each battery individually or also for all steam generators in common. For example, an electrically or pneumatically controllable supply shut-off valve can be provided upstream of the water inlet and an electrically or pneumatically controllable outlet shut-off valve could be provided downstream of the steam outlet. However, individually controllable (dosing) valves could also be provided additionally or alternatively for each steam generator, in particular, for the water inlet. The control unit can perform the control in a coordinated manner for dosing the steam generation, in particular, the supply shut-off valve, the dosing valves, and/or the outlet shut-off valve.

In one embodiment corresponding to the construction according to DE 10 2016 107 840.9, the cleaning chamber can be constructed as a cleaning container that can be closed. Here, the handling device can be a workpiece-specific holding and feeding device that can hold the workpiece, feed it into the cleaning container and back out again, and move it relative to the steam nozzle. Alternatively, an industrial robot, e.g., an articulated-arm robot, that can be used universally for different workpieces, could be provided. In both cases, the handling device can preferably have a pressure-tight closure for the cleaning container.

In an alternative embodiment, an industrial robot with at least four degrees of freedom can be provided in the cleaning chamber, on which the steam nozzle is arranged, in order to move it relative to the workpiece. The workpiece can be held fixed in place during the cleaning or it can also be held so that it can be positioned by a second handling device.

According to an embodiment of the invention, a steam generator is proposed that is suitable especially but not exclusively for a device or system according to one of the preceding embodiments, i.e., is designed for use in any type of cleaning device.

In the simplest embodiment, the steam generator according to an embodiment of the invention has a core that is heatable from the outside, e.g., a hollow cylinder that is closed pressure-tight or is arranged in a pressure-tight steam generator container, a spray nozzle that is arranged inside the core or hollow cylinder and is connected to a water inlet guided preferably through one end face and also to a steam outlet. According to an embodiment of the invention, the spray nozzle is directed onto the heatable inner surface of the core, so that water can be sprayed onto this inner surface in a dosed manner.

In one preferred embodiment, the steam generator comprises, in a cartridge-like construction:

- a heatable, pressure-tight core made from thermally conductive material with an inner cavity,
- a heating device for heating the core, particularly from the outside,
- a water inlet that is guided through one end face,
- a spray nozzle arranged axially relative to the core or hollow cylinder, preferably with hollow-cone characteristics, which directs water onto an inner surface of the core, and
- a steam outlet for discharging the generated steam to a cleaning process.

Advantageously, the steam outlet is arranged on the end face of the core or hollow cylinder opposite the water inlet, preferably in the axis of the core or hollow cylinder.

The steam generator can have the features already explained above as preferred.

In one preferred refinement of the invention, e.g., an additional heating device, in particular axially on the inner surface of the end face opposite the water inlet, is mounted so that it carries a flow of steam generated in the, e.g., hollow cylindrical core for post-heating this flow of steam before it reaches the steam outlet.

The heating of the pressure-tight core or hollow cylinder (primary heating device) can be realized in any known way, for example, by a fluid heat transfer medium that is guided through a corresponding jacket with supply and discharge lines. Electrical heating is preferred, for example, in the form of a resistive wire or heating conductor. This resistive wire or heating conductor can be mounted on the outer jacket surface of the core in a heat-conducting manner in a preferred shape, for example, as a spiral coil with electrical insulation.

The electrical heating can be realized so that the heat output emitted by it can be influenced by a control unit. Here, the primary heating device, and preferably also the additional secondary heating device, can each have at least one separately controllable electrical heating element. The primary heating device preferably comprises one or more heating conductors that are mounted peripherally and axially distributed in a heat-conducting manner on the outside of the core. The supplementary heating device can comprise, e.g., several heating elements distributed around the axis or one wrap-around heating conductor.

Here, a single spray nozzle can be arranged in the axis of the core. Especially preferred is a nozzle with symmetric spray characteristics, in particular with hollow cone characteristics. In this way, the spray jet is directed in a rotationally symmetric manner onto the inside of the heatable core and the entire inner surface of the core downstream of the impact point of the spray jet is available for heat transfer. Depending on the necessary quantity of steam, multiple spray nozzles could also be distributed in a rotationally symmetric manner about the cylinder axis, in order to also obtain the smallest possible droplet size with larger volume flows.

In addition, the steam generator according to an embodiment of the invention comprises means for controlling the water inlet and the steam flow, for example, valves. Preferably, these valves can be adjusted by electrical signals, for example, from a control unit.

The core of the steam generator according to an embodiment of the invention is preferably constructed from a heat-conductive and corrosion-resistant material, for example, stainless steel.

The electrical heating of the core is preferably thermally insulated from the outside, so that no non-economical heat losses occur. For this purpose, known insulation materials can be used, such as glass wool, inorganic porous materials, elastic and plastic, optionally hardened thermally stable polymer foams. One suitable material is, for example, Conti Thermo Protect® (ContiTech AG, Hannover). A reflective jacket, for example, made from sheet steel, arranged on the inside over the heating conductor and optionally insulated by an air gap from the heating conductor, also supports the thermal insulation.

Between such thermal insulation and the core, there is preferably a thermally reflective inner jacket, e.g., with silvering for reflecting thermal radiation.

The invention also includes a method for cleaning workpieces with a steam jet that is characterized in that it is constructed by means of a steam generator as described above.

This method can comprise the feeding, the relative movement of the workpiece and the at least one steam nozzle, the switching on of the steam jet, optionally the controlling of the steam jet corresponding to the positioning of the workpiece to the steam nozzle, and removing the workpiece from the cleaning chamber. Here, the steam generation is controlled using the steam generator according to an embodiment of the invention and the workpiece conveying and/or relative movement to the steam nozzles preferably in a coordinated manner. Advantageously, the steam jet can be generated in a pulsed form only during the time period of the cleaning process and can be switched off while the workpiece is conveyed into and out of the cleaning container and also while the device is shut down. This already produces considerable additional energy savings. The steam generator according to an embodiment of the invention is especially suitable for such synchronized operating modes due to the dosed supply of water as needed and low mass relationships.

Advantageously, here the heating output fed to the steam generator is switched with respect to time corresponding to the flow of steam fed to the steam nozzle in the cleaning device. Here, in addition to the obvious energy savings, the cleaning process and uniform conditions are achieved, which leads to better results.

On the other hand, during a cleaning cycle, the workpiece can be positioned or moved differently relative to the steam nozzle/s and the cleaning effect can be adjusted through controlled changing of the heating output and/or changed settings of a valve on the steam outlet depending on the properties of the currently treated position on the workpiece, such as degree of soiling or surface shape. In a training process for the series production-ready synchronized manufacturing process, an optional control unit can be set accordingly based on the observed cleaning results.

The application area of the device according to an embodiment of the invention is, in particular, the cleaning of workpieces during production, preferably before further processing and after metal-cutting forming. The device can be easily integrated into assembly lines with specified cycles. In particular, the invention is suitable for use in manufacturing systems engineering, especially for automobile parts, especially preferred for the production of drive train and transmission components for automobiles and other motor vehicles. The system or method is also advantageous for the steam cleaning of body parts.

The steam generator according to an embodiment of the invention can achieve a degree of efficiency >95%. Additional advantages of the invention are reduced space and footprint requirements compared with typical systems, good cleaning results even for different components, because the positioning of the steam nozzles relative to the workpiece and the application of steam can be changed quickly and flexibly to the workpiece, and finally a significantly reduced energy consumption. Comparison tests with a conventional steam generator showed savings of at least 25% just in electrical power consumption.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1A:
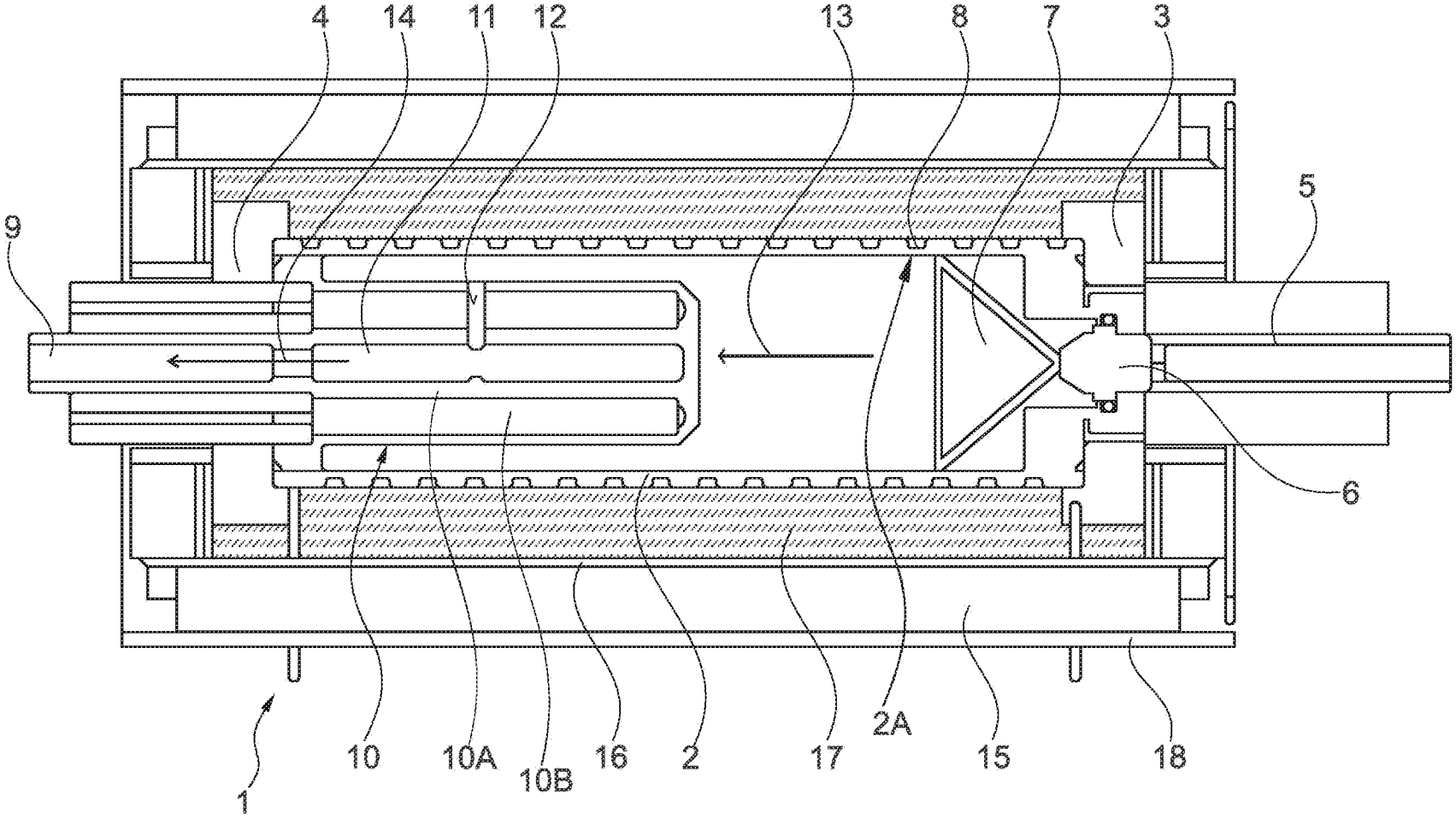
FIG. 1A is a longitudinal sectional view of an individual steam generator unit of the device according to an embodiment of the invention.

In FIG. 1A, a steam generator 1 is shown in a horizontal arrangement in a longitudinal section, but in practice, a vertical arrangement of the hollow cylindrical axis would be preferred. The steam generator 1 comprises, in its interior, a hollow cylindrical jacket that consists essentially of a special core 2, a first end face 3, and a second end face 4 opposite the first end face. The end faces 3, 4 are designed like a flange and seal the core 2 pressure-tight.

In the axis of the first end face 3, a water inlet 5 is mounted, which feeds a hollow cone spray nozzle 6, wherein here the terms injection nozzle and spray nozzle refer to identical components. Water flowing through the water inlet 5 into the hollow cone spray nozzle 6 is sprayed in a dosed manner to form a hollow cone-shaped spray jet 7 that is sprayed onto the inner surface of the core 2. The feed water pressure is preferably in the range from approx. 2 to 9 bar (atm). The nozzle geometry, in particular, jet angle and nozzle cross section of the spray nozzle 6 are selected so that low water consumption can be achieved, e.g., <0.15 l/min.

Because the core 2 is heated by one or more electrical heating conductors 8, water from the spray jet 7 vaporizes when it impacts the core or while it flows downward on the inner surface of the core 2 and is converted into saturated steam, whose flow is indicated by the arrows 13. Several heating conductors 8, each with approx. 1.2-3.6 kW power can be provided as the primary heating device, e.g., in double spirals on the outside of the core 2. Preferably, receptacle grooves for the heating conductor 8 can be provided on the outside of the core 2 (FIG. 1B).

In the axis of the core 2, an additional heating device 10 is arranged, e.g., a heated hollow cylinder with approx. 4 to 8 heating elements 10B distributed coaxially around the axis, each, e.g., with 500W electrical power. The power of the heating element 10B of the additional heating device 10 is controlled separately from the primary heating device with the heating conductors 8 and is supplied with energy here by not shown electrical connections. The supplementary heating device 10 makes it possible to selectively generate also dry steam (superheated steam). The heating device 10 has a body 10A with an axial hole 11, which is connected to the steam outlet 9 on the second end face 4. Thus, the saturated steam 13 generated on the heated core 2 can flow through one or more passage openings 12 into the hole 11 in the body 10A of the additional heating device 10 and can be led from there to the steam outlet 9, where the steam is led via a valve to one or more steam nozzles (FIG. 3) in a cleaning chamber. If energy is fed to the heating device 10, then the saturated steam 13 is further heated in the sense of post-heating and leaves the steam outlet 9 as dry steam 14. The heating elements 10B of the heating device 10 can be optionally controlled individually, in order to be able to precisely set the steam parameters.

The heating elements 10B can be mounted distributed about the hole 11 in the body 10A, e.g., each in a corresponding axial hole open toward the end face 4 and are connected in a heat conductive manner to the body 10A, e.g., in that the heating elements 10B are mounted in a force-fit connection in the body 10A.

Figure 1B:
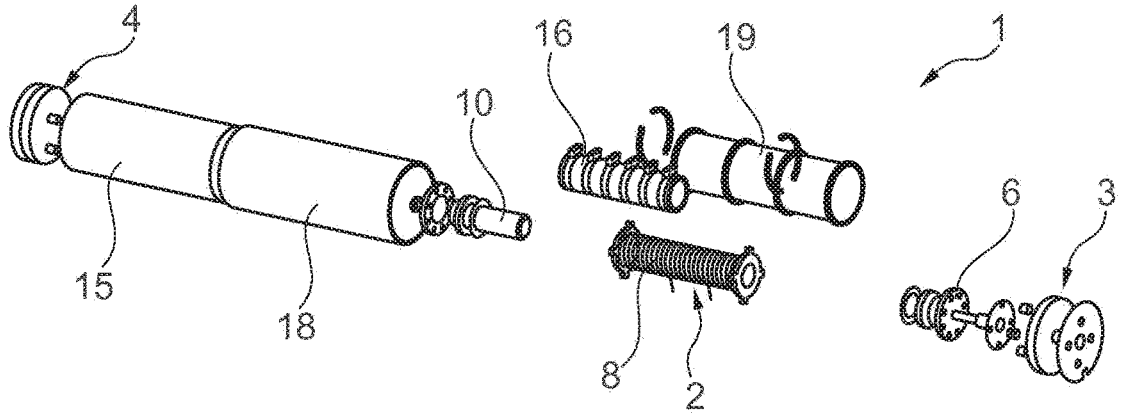
FIG. 1B is an exploded view of the steam generator unit of FIG. 1A.

FIG. 1B illustrates the preferred compact, axially nested construction of the steam generator 1 according to FIG. 1A, in the form of a steam cartridge. FIG. 1B shows structurally identical components with the same reference symbols as FIG. 1A.

The jacket-like core 2 is a specially prepared, one-piece molded part made from stainless steel with a cylindrical inner surface (FIG. 1A) and sealing flanges on the end face for the pressure-tight connection to flange elements of the end faces 3, 4. On the outside, spiral, wrap-around receptacle grooves are formed for, e.g., strip-like heating conductors 8. The core 2 is constructed here, as FIGS. 1A-1B show, similar to a hollow cylinder with a cylindrical inner surface 2A and should have the smallest possible mass.

Between the thermally reflective inner jacket 16 and the spacer 19 on which the insulating material 15 is mounted, additional insulation can be optionally provided. The end faces 3, 4 have a flange-like configuration made from individual parts that are sealed on the end-face flanges of the core 2, thermally insulate and at the same time connect the inner jacket 16 and the outer jacket 18 coaxially and rigidly to the core 2. The supplementary heating device 10 is held coaxially inside the core 2 (FIG. 1A) and leaves a cylindrical, peripheral free space, in order to obtain a maximum vaporization surface area on the inner surface of the core 2. The structural length and diameter of the core 2 are matched to the geometry, in particular, the spray cone angle, of the spray nozzle 6. The cartridge-like construction shown in FIGS. 1A-1B simplifies, among other things, maintenance work, e.g., replacing the spray nozzle 6.

The silvering on the inner jacket 16 reduces losses due to thermal radiation. Between this inner jacket 16 and the outer surface of the core 2, a jacket-shaped, peripheral air gap 17 is provided as additional insulation. Instead of the air gap 17, with corresponding added expense, a vacuum or low pressure can also be provided here according to the principle of a Dewar flask; this, however, makes the construction and maintenance more difficult.

Figure 1C:
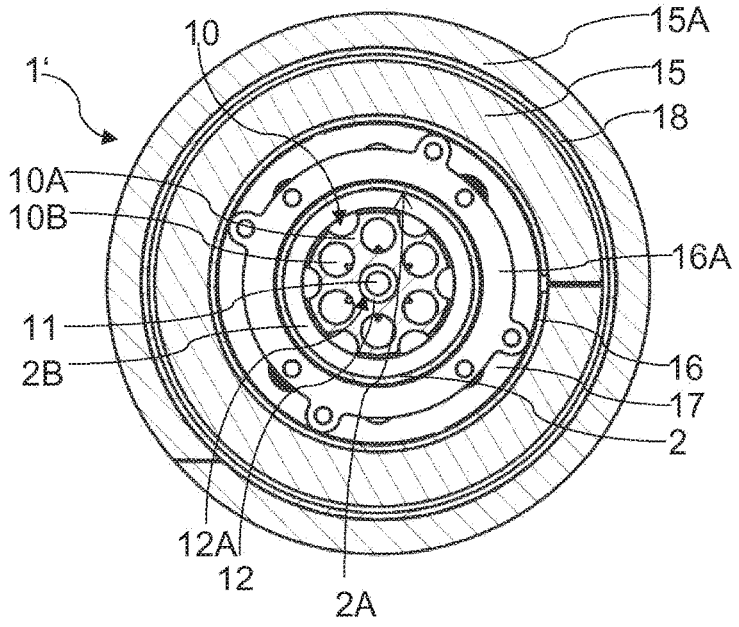
FIG. 1C is a sectional view of another steam generator unit according to an embodiment of the invention.

A preferred refinement of a steam generator 1' according to the principle from FIGS. 1A-1B is shown in FIG. 1C in cross section. The steam generator 1' differs primarily in that a passage opening 12, here exactly one passage opening, is provided coaxially in the body 10A of the reheater 10, namely on the side of the spray nozzle 6. The passage opening 12 leads from the primary cavity 2B into the secondary cavity 11, e.g., a hole in the body 10A. This passage opening 12 also causes a pressure difference with lower pressure in the secondary cavity 11, e.g. 3.5 bar, relative to the operating pressure in the primary cavity 2B of the core 2, e.g., approx. 4 bar. The cross-sectional constriction of the passage opening 12 prevents a discharge of non-vaporized water mist. By decompressing the steam or reducing the pressure in the secondary cavity 11, dry steam 14 can also be prepared while supplying less energy. For generating a predetermined pressure reduction, e.g., a nozzle 12A or another component like a throttle, aperture, or the like could be provided on or as the axial passage opening 12, e.g., in an axial threaded hole on an end face on the body 10A. Furthermore, FIG. 1C shows one of two retaining rings 16A made from material with low heat conductivity, with which the reflective inner jacket 16 is held on the end face in point contact at a distance relative to the inner surface 2A of the core 2. Each retaining ring can be screwed onto the core 2, e.g., on the end face. In addition to the insulation 15 on the inside on the outer jacket 18, according to FIG. 1C for thermal insulation, external insulation 15A is also provided, with which the outer jacket 18 is surrounded.

Other details from FIG. 1C match FIGS. 1A-1B, e.g., the hollow cylindrical inner surface 2A of the core 2 and the round cylindrical shape of the inner jacket 16 and outer jacket 18. Furthermore, e.g., FIG. 1C also shows the peripheral, symmetric distribution of the heating element 10B, here, e.g., six pieces, in the body 10A and the shape of the body 10A as a rotational body in cross section, with outer recesses for increasing the heat transfer effective to the outside to the primary cavity 2B and reducing the mass of the body 10A. The outside of the body 10A can have a conical profile toward the nozzle 6 and is, in any case, at a distance to the inner surface 2A of the core 2. Through the complete, here coaxial, holding of the reheater 10 in the inner cavity 2B of the core 2, the energy requirements are further reduced. In addition, the primary cavity 2B, thanks to the pressure reduction through the passage opening 12, can form a certain kind of steam buffer, so that dry steam 14 is generated as needed if a drop occurs at the steam outlet 9. The replaceable heating elements 10B can be inserted or pressed in as C-shaped heating elements that "unfold" in cross section into axial holes from the end face 4, in order to form a rigid and planar contact on the body 10A, as shown schematically in FIG. 1C.

Figure 2:
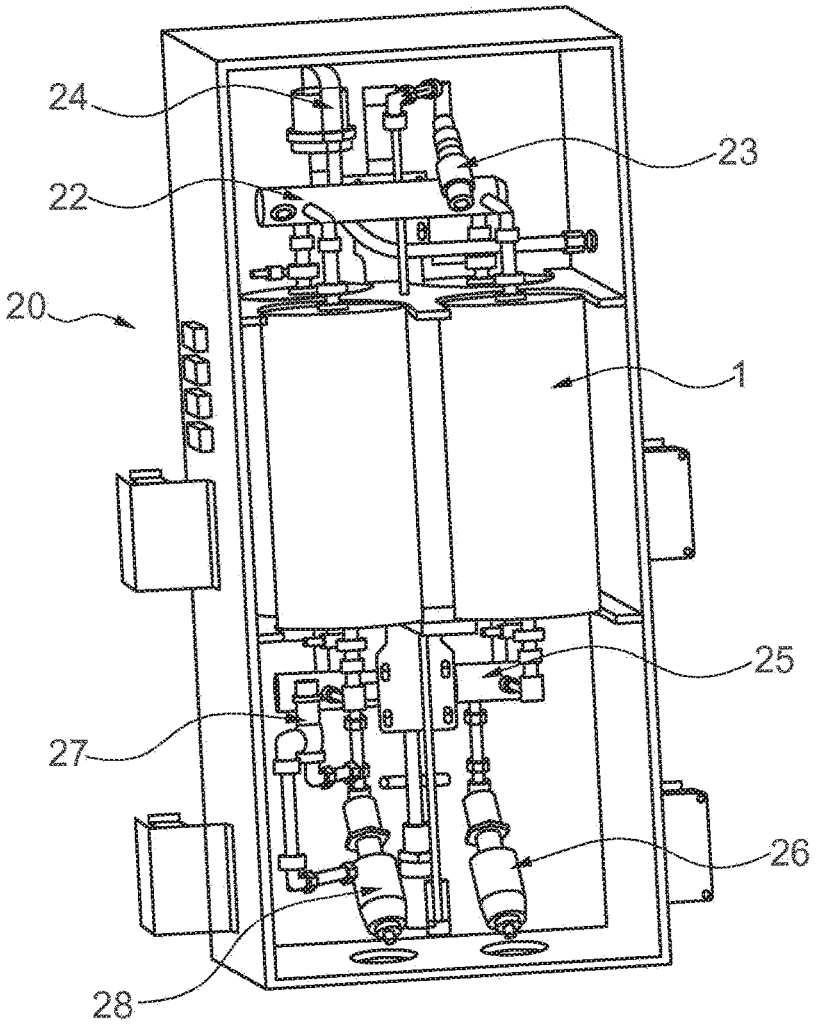
FIG. 2 is a perspective view of a steam generator battery with two units according to FIG. 1A and associated line and valve technology.

FIG. 2 shows a steam generator battery 20 with two or four steam cartridges or steam generators 1, e.g., each with approx. 4-6 kW heating power, in the construction according to FIGS. 1A-1B. The modular steam generator battery 20 according to FIG. 2 can generate approx. 18-20 kg/h wet steam at nominal approx. 2-4 bar operating pressure and can be optionally provided multiple times in parallel arrangement. For pulsed operation, steam can be discharged at a maximum pressure of >10 bar. On the input side, the water feeds of the steam generator units 1 are connected via a common feed water distributor 22 to a pneumatically/electrically controllable dosing/shut-off valve 23 for the dosed application with feed water. The feed water distributor 22 guarantees a uniform feed pressure to the spray nozzles 6 (FIG. 1) of the two steam generators 1. Pressure relief 24 on the feed water distributor 22 prevents air from entering into the spray nozzles 6 (FIG. 1). On the output side, each steam outlet 9 (FIG. 9) is connected directly to a steam distributor 25. The steam distributor 25 has, on one side, a controllable shut-off valve 26 for the controlled steam discharge to steam nozzles of a cleaning chamber of the cleaning device or system (see FIG. 3). A pressure-limiting valve or safety valve 27 on the steam distributor 25 protects the steam cartridges 1 from excess pressure. On the other side, the steam distributor 25 is connected to a valve 28 for the quick steam outlet (pressure outlet), e.g., for a controlled emergency shutdown (emergency off).

Figure 3:
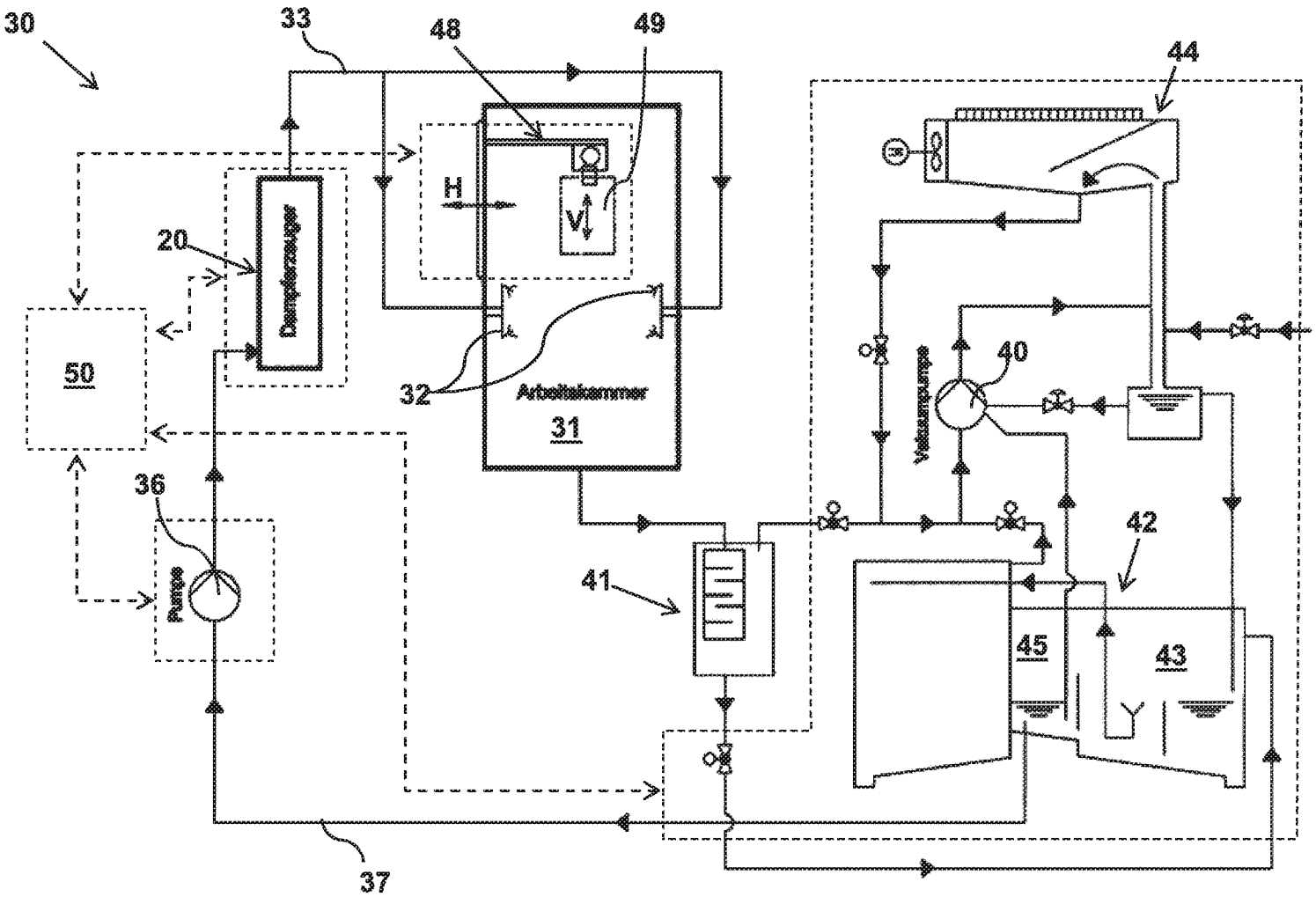
FIG. 3 is a simplified flow diagram of an industrial cleaning system with a steam generator battery according to FIG. 2.

FIG. 3 shows an overview diagram of the cleaning system 30 with at least one, preferably 2 to 4, steam generator batteries 20 in the construction according to FIG. 2. In the cleaning or treatment chamber 31, there are multiple steam nozzles 32, here, e.g., on two opposite rotor-like support arms, which perform a rotational motion for the planar cleaning of the workpiece 49 during the steam cleaning. The steam nozzles 32 can have a known construction and are supplied by a steam supply line 33, which is connected at the output of the steam generator battery/batteries 20, more specifically to the steam distributor 25 (FIG. 2).

FIG. 3 further shows a return circuit of the cleaning system 30, with which cleaning fluid is recovered from the treatment chamber 31. The vapors occurring due to the low pressure are suctioned from the treatment chamber 31 via a first filter unit 41 by a vacuum pump 40 and then fed to a downstream second filter and separator stage 42, which has an oil separator 43. The outlet of the filter unit 41 opens into the oil separator 43. On the output side, the vacuum pump 40 is connected to a condensation unit 44, whose return also opens in the oil separator 43. From a clean tank 45 in the second filter and separator stage 42, the steam generator battery 20 with the individual steam generators 1 is fed via a water pump 36 in a supply line 37 via the feed water distributor/s 22. The water pump 36 generates the desired feed water pressure for the individual steam generators 1, e.g., approx. 8 bar (atm). The steam generators 1 deliver, depending on the nozzle geometry, heating output, and operating mode, a desired steam pressure, e.g., in the range from 2 to 6 bar (atm) at the steam nozzles 32.

The output pressure of the steam generator 1 or the steam distributor 25 (FIG. 2) and optional additional suctioning effect of the vacuum pump 40 improves the spraying of steam at high dynamic jet pressure and thus also the cleaning effect. Operating the cleaning chamber 31 at low pressure is purely optional. In the closed circuit according to FIG. 3, the condensed discharge water (optionally with vapor) condensed out of the cleaning chamber 31, so that cleaning fluid is recovered. In addition, residual heat of the recovered cleaning fluid can be utilized for the purpose of additional energy savings. Fresh water is fed only as needed due to the losses, among other things, in the second filter and separator stage 42. The recovery is especially advantageous, when distilled or demineralized water is used for generating the steam, in order to guarantee a long operating period of the steam generator 1, especially of the hollow cone spray nozzles 6.

FIG. 3 shows, purely as an example and schematically, an automatic handling device 48 for the workpiece 49, which can be moved automatically into and back out of the treatment chamber 31 on two axes H, V. The handling device 48 moves the workpiece 49 relative to the steam nozzles 32 into the treatment chamber 31. The handling device 48 also has a pressure-resistant closure that closes the opening of the treatment chamber 31 in the operating position in a pressure-tight manner.

In an alternative embodiment (not shown here), one or more steam nozzles 32 can be arranged in the treatment chamber 31 on an automatic handling device and are herewith selectively positioned and/or moved relative to the workpiece. For this purpose, e.g., a 6-axis industrial articulated-arm robot can be used (see FIG. 1 in WO 2011/124 868 A1).

FIG. 3 shows a fully automatic system control unit 50, which controls the operation of the steam generator battery/batteries 20 in a coordinated way with the operation of the cleaning chamber 31, e.g., synchronized operation of the automatic handling device 48. The system control unit 50 can also control the feed water pump 36 and/or regulate it in an energy-optimized way, e.g., by regulating the rotational speed. The control and measuring lines of the system control unit 50 are constructed using known technology and indicated here schematically with dashed lines. The system control unit 50 can also advantageously control actuators and sensors of the return circuit, e.g., the control valves, vacuum pump 41, and condensation unit 44 with respect to the operation of the cleaning chamber 31 and the steam generator 20 in a coordinated way and/or as needed, in order to realize additional energy savings.

Each steam generator battery 20 can be controlled individually here as needed, in agreement with the synchronized operation of the operating chamber 31 and/or the requirements of the cleaning process of the steam nozzles 32 by the system control unit 50. By means of separate dosing valves (not shown), each steam generator 1 in a steam generator battery 20 can be optionally controlled individually, in order to be able to adjust the steam output even more precisely.

One especially simple solution for the synchronized output of steam, especially dry steam 14, from the steam generator battery/batteries 20 can be realized by a suitable control valve (not shown) in the steam supply line 33, which is controlled by the system control unit 50 as needed. The control valve is preferably arranged close to the steam nozzles 32 with short residual line. For optimizing energy, the system control unit 50 controls the water supply via the feed valve 23 and also the heat output of each steam generator 1 via the primary and secondary heating devices 8, 10A as needed in agreement with the automated cleaning.

Figure 4:
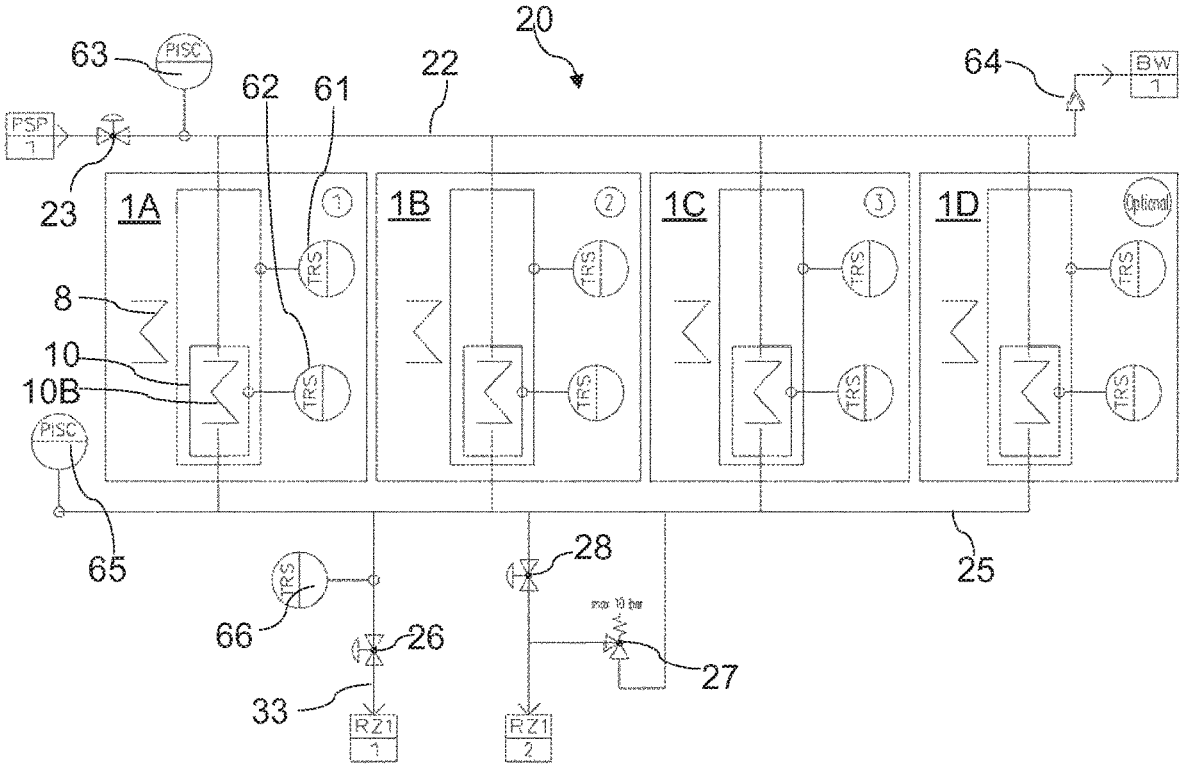
FIG. 4 is a simplified raw material line and instrument flow schematic of a steam generator battery with steam generator units according to an embodiment of the invention.

FIG. 4 shows a steam generator battery 20 with measuring elements and control elements preferably provided for the process control or regulation by the system control unit 50 and, e.g., four structurally identical steam generators 1A, 1B, 1C, 1D according to FIGS. 1A-B and FIG. 1C. Parts with identical functions according to FIGS. 1-3 have the same reference symbols in FIG. 4.

In each steam generator 1A . . . 1D there is a primary temperature sensor 61 (not in FIGS. 1A-1C) on the core 2 for controlling or regulating the power of the primary heating device 8 as a control element, e.g., to a target temperature up to 600° C. Accordingly, for the independent control or regulation of the secondary heating device 10B of the reheater 10 as a separate control element, a secondary temperature sensor 62 (not in FIGS. 1A-1C) could also be provided on the body 10A. The temperature sensors 61, 62 are connected as measuring elements to the system control unit 50. The system control unit 50 is also connected to a pressure sensor 63 on the feed water distributor 22. By means of suitable control elements, e.g., the control unit of the feed pump (see FIG. 3 at input "PSP") and/or an overflow valve 64, the feed pressure can be set or regulated, either by the system control unit or optionally as a fixed preset condition, to a feed pressure, e.g., up to 8 bar. If no steam is required, the system control unit 50 switches off the water feed by means of the controllable feed valve 23.

An additional pressure sensor 65 is provided as a measuring element on the steam distributor 25 and measures the steam pressure discharged at the steam outlet 9, among other things, for the controlled pressure relief via the safety valve 28 controllable by the system control unit 50 in the cleaning chamber (output "RZ1-2"). The system control unit also controls the controllable discharge valve 26 in the steam supply line to the steam nozzle/s, which is preferably used as a pure shut-off valve. Furthermore, on the steam distributor 25 or the steam supply line 33, there is a temperature sensor 66 connected to the system control unit 50. The measurement by the pressure sensor 65 and by the temperature sensor 66 can be included, e.g., in the control or regulation of the post-heating and/or the controlled steam discharge by means of a control valve (not shown) close to the steam nozzles or the discharge valve 26. In the steam supply line 33 (between output "RZ1" and the cleaning chamber), a pressure-regulating valve can be provided, which is preset for a desired steam pressure or is set by the system control unit 50 actively as needed or to the required steam pressure for the steam cleaning.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

LIST OF REFERENCE SYMBOLS

FIG. 1A-1B

1 Steam generator
2 Core
2A Inner surface
3 First end face of the hollow cylinder
4 Second, opposite end face of the hollow cylinder
5 Water inlet
6 Spray nozzle/hollow-cone nozzle
7 Hollow-cone-shaped spray jet
8 Heating conductor (primary heating device)
9 Steam outlet
10 Reheater (supplementary heating device)
10A Body of the reheater
10B Heating element
11 Hole (secondary cavity)
12 Passage opening (radial)
13 Saturated steam
14 Dry steam
15 Insulating material
16 Reflective inner jacket
17 Air gap
18 Outer jacket
19 Spacer

FIG. 1C

1' Steam generator
2 Core
2A Inner surface
2B Primary cavity
10 Reheater (supplementary heating device)
10A Body of the reheater
10B Heating element
11 Secondary cavity
12 Passage opening (axial)
12A Nozzle
15 Insulating material
15A Outer insulation
16 Reflective inner jacket
16A Retaining ring
17 Air gap
18 Outer jacket

FIG. 2

1 Steam generator
20 Steam generator battery
22 Feed water distributor
23 Controllable feed valve
24 Exhaust
25 Steam distributor
26 Controllable discharge valve
27, 28 Safety valves

FIG. 3

20 Steam generator battery
30 Steam cleaning system
31 Cleaning chamber
32 Steam nozzle
33 Steam supply line
36 Feed water pump
37 Feed water supply line
40 Vacuum pump
41 First filter unit
42 Second filter unit
43 Oil separator
44 Condensation unit
45 Clean tank
48 Handling device
49 Workpiece
50 System control unit

FIG. 4

1A, 1B, 1C, 1D Steam generator
8 Primary heating device
10 Reheater (supplementary heating device)
10B Secondary heating device
20 Steam generator battery
22 Feed water distributor
23 Controllable feed valve
25 Steam distributor
26 Controllable discharge valve
27 Safety valve (manually preset)
28 Controllable safety valve
33 Steam supply line
61 Primary temperature sensor (steam generator)
62 Secondary temperature sensor (steam generator)
63 Pressure sensor (feed water)
64 Overflow valve (feed water)
65 Pressure sensor (steam discharge)
66 Temperature sensor (steam discharge)

The invention claimed is:

1. A steam generator (1) for generating dry steam for an automated industrial cleaning system (30) for cleaning workpieces by means of a steam jet, comprising a steam generator container with a water inlet (5) and a steam outlet (9);

a heatable core (2) of thermally conductive material arranged in the steam generator container and having an inner primary cavity and an inner surface (2A);

a primary heating device (8) for heating the core (2);

a spray nozzle (6) connected to the water inlet (5) and arranged to spray water in a dosed manner onto the inner surface (2A) of the core (2); and an additional supplementary heating device (10) provided in the steam generator container upstream of the steam outlet (9) and at least partially inside the core (2);

wherein the supplementary heating device (10) comprises a heatable body (10A) having a secondary cavity (11) through which steam (13) generated upstream in the primary cavity of the core (2) can flow for post-heating it to dry steam (14) and which is connected at an inlet side via a passage opening (12) to the primary cavity of the core (2) and at an outlet side to the steam outlet (9).

2. The steam generator (1) according to claim 1, wherein the passage opening (12) comprises or forms a cross-sectional constriction which causes a pressure difference with a lower pressure in the secondary cavity (11) of the supplementary heating device (10) than in the primary cavity inside the core (2).

3. The steam generator (1) according to claim 1, wherein the passage opening (12) is provided radially or axially with respect to a longitudinal axis of the core (2).

4. The steam generator (1) according to claim 1, wherein the primary heating device comprises a controllable electrical heating element (8) and that the supplementary heating device (10) comprises at least one separately controllable electrical heating element (10B).

5. The steam generator (1) according to claim 1, wherein the supplementary heating device (10) is accommodated at least to a major proportion of its overall length or completely with the heatable body (10A) axially inside the core (2).

6. The steam generator (1) according to claim 1, wherein the spray nozzle (6) is arranged axially to the hollow cylindrical core (2) and/or is directed towards the cylindrical inner surface (2A) of the core (2), wherein the spray nozzle (6) being designed with hollow cone characteristics.

7. The steam generator (1) according to claim 1, wherein the water inlet (5) is arranged at one end face (3) and the steam outlet (9) is arranged at the other end face (4), wherein the supplementary heating device (10) is mounted on the end face (4) opposite the water inlet (5).

8. The steam generator (1) according to claim 1, wherein the core (2) is in the shape of a hollow cylinder with a cylindrical inner surface (2A) and/or the steam generator container is configured in substantially cylindrical shape with an inner core (2), which is closed in a pressure-tight manner at the end faces (3, 4), wherein a thermal insulation (15) is provided between the inner core and an outer jacket (18) of the steam generator container.

9. The steam generator (1) according to claim 8 wherein the steam generator container has a thermally reflective inner jacket (16) between the thermal insulation (15) and the core (2).

10. The steam generator according to claim 1, wherein the core (2) is designed in the form of a jacket or hollow cylinder made in one piece of stainless steel with a cylindrical inner surface (2A) and end facing connecting flanges, for pressure-tight sealing at the end faces (3; 4); and/or exactly one passage opening (12) or more passage openings (12) are provided in the heatable body (10A); and/or the water inlet (5) and the steam outlet (9) are coaxially provided on opposite end faces (3, 4) of the core of the steam generator container; and/or the spray nozzle (6) has a spray characteristic coaxially aligned with the axis of the core (2); and/or the steam generator container is oriented vertically with its cylinder axis in an operating position; and/or the additional supplementary heating device (10) is arranged on the axis of the cylindrical steam generator container at the steam outlet (9).

11. An industrial cleaning system (30) for cleaning workpieces by means of a steam jet, comprising:

a cleaning chamber (31) with at least one steam nozzle (32) in the cleaning chamber, a handling device (48) capable of positioning a workpiece and the at least one steam nozzle relative to one another; and at least one steam generator (1), which supplies the steam nozzle with steam, the at least one steam generator (1) comprising:

a steam generator container with a water inlet (5) and a steam outlet (9);

a heatable core (2) of thermally conductive material arranged in the steam generator container and having an inner primary cavity and an inner surface (2A);

a primary heating device (8) for heating the core (2);

a spray nozzle (6) connected to the water inlet (5) and arranged to spray water onto the inner surface (2A) of the core (2); and an additional supplementary heating device (10) provided in the steam generator container upstream of the steam outlet (9) and at least partially inside the core (2), the supplementary heating device (10) comprising a heatable body (10A) having a secondary cavity (11) through which steam (13) generated upstream in the primary cavity of the core (2) can flow for being post-heated (14) and which is connected at an inlet side via a passage opening (12) to the primary cavity of the core (2) and at an outlet side to the steam outlet (9).

12. The cleaning system according to claim 11, wherein a dosing valve is provided between the steam outlet (9) of the steam generator (1) and the at least one steam nozzle in order to discharge steam in dosed and/or pulsed form; and/or upstream of the water inlet a pump (36) is arranged, which applies a feed water pressure suitable for injection to the spray nozzle (6).

13. The cleaning system according to claim 11, wherein the system comprises a control unit (50) which controls at least the relative movement between the workpiece (49) and the steam nozzle (32) and the operation of the at least one steam generator (1) in a coordinated manner, and a controllable outlet shut-off valve (26) is provided downstream of the steam outlet, wherein the control unit (50) controls the outlet shut-off valve (26).

14. The cleaning system according to claim 11, wherein the cleaning chamber (31) is designed as a closable cleaning container and the handling device (48) is a holding and conveying device which is capable of holding the workpiece (49), conveying it into and out of the cleaning container (31), and moving the workpiece (49) relative to the steam nozzle (32); and/or an industrial robot with at least four degrees of freedom is provided in the cleaning chamber (31), on which the steam nozzle (32) is arranged in order to move it relative to the workpiece.

15. A device according to claim 1, wherein a plurality of identical steam generators (1) are provided in a battery arrangement (20), which have a common water distributor (22) for feeding the individual water inlets (5) and a common steam distributor (25), supplied by the individual steam outlets (9), for discharging steam.

16. An industrial cleaning system (30) for cleaning machined components for a drive train of a motor vehicle, comprising the steam generator of claim 1.

17. The steam generator (1) according to claim 6, wherein the spray nozzle (6) is designed with a hollow cone nozzle characteristic and/or with a nozzle geometry which ensures a volume flow of <0.2 l/min at a nozzle inlet pressure of ≤10 bar.

18. The steam generator (1) according to claim 1, wherein the core has a hollow cylindrical configuration and wherein the supplementary heating device (10) is mounted coaxially in the core (2) and completely accommodated therein.

19. The cleaning system according to claim 13, wherein a controllable supply shut-off valve (23) is provided upstream of the water inlet (5) and the control unit (50) controls the supply shut-off valve (23) and the outlet shut-off valve (26) in a coordinated manner.

* * * * *